US008066585B2

(12) United States Patent
Tremulis et al.

(10) Patent No.: US 8,066,585 B2
(45) **Date of Patent: *Nov. 29, 2011**

(54) GOLF CLUB GRIP

(76) Inventors: William S. Tremulis, Redwood City, CA (US); Michael John Deg, Highland Park, IL (US); Kyle Thomas Deg, Highland Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/372,207

(22) Filed: Feb. 17, 2009

(65) Prior Publication Data

US 2009/0209359 A1 Aug. 20, 2009

Related U.S. Application Data

(63) Continuation of application No. 10/888,466, filed on Jul. 9, 2004, now Pat. No. 7,510,483.

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | | |
|---|---|---|---|---|
| 4,617,697 | A * | 10/1986 | David | 16/421 |
| 5,000,599 | A * | 3/1991 | McCall et al. | 401/6 |
| 5,322,290 | A * | 6/1994 | Minami | 473/201 |
| 5,634,859 | A | 6/1997 | Nesbitt | |
| 5,653,643 | A * | 8/1997 | Falone et al. | 473/300 |
| 5,876,134 | A * | 3/1999 | Tseng et al. | 401/6 |
| 5,944,617 | A * | 8/1999 | Falone et al. | 473/300 |
| 6,148,483 | A * | 11/2000 | DeGraff | 16/430 |
| 6,447,190 | B1 | 9/2002 | Kwitek | |
| 7,334,298 | B2 * | 2/2008 | Willat et al. | 16/435 |
| 7,335,325 | B1 * | 2/2008 | Pierson | 264/223 |
| 2003/0029002 | A1 | 2/2003 | Wilatt | |

FOREIGN PATENT DOCUMENTS

WO WO0132439 5/2001

OTHER PUBLICATIONS

Letter (3 pages), dated Jun. 29, 2010 from Patent Examiner for the Melbourne Patent Examination Centre to Baldwins Intellectual Property in Wellington, New Zealand—Re: Examiner's first report on patent application No. 2005265352 by William S. Tremulis, Kyle Thomas Deg and Michael John Deg.

European Patent Office, Communication with extended European Search Report, in Application No. 10193821.5-2318, dated Apr. 5, 2011.

Japanese Patent Office, Notice of Reasons for Rejection for Application 2007-520577, dated Nov. 2, 2010.

Japanese Patent Office, Decision on Final Rejection for Application 2007-520577, dated Mar. 1, 2011.

* cited by examiner

*Primary Examiner* — Stephen L. Blau
(74) *Attorney, Agent, or Firm* — McAndrews, Held & Malloy, Ltd.

(57) ABSTRACT

A pre-molded or moldable shaft grip includes a pre-configured or moldable section disposed within a substantially circular outer grip layer. A pre-configured or moldable section substantially conforms to a player's grip, facilitating consistent finger placement. The pre-configured section may comprise the shaft, a separate section, or multiple sections of varying durometer. The moldable section may include a layer of moldable material, or a cavity disposed between the outer grip layer and the shaft containing a moldable substance. Overall grip durometer can be adjusted by varying the pressure within the cavity.

14 Claims, 10 Drawing Sheets

43
48
47
46
45
47

49
48
46
47
49

46
48
43
45

43
48
47
45

GOLF CLUB GRIP

RELATED APPLICATIONS

This application is a continuation application of Ser. No. 10/888,466, filed Jul. 9, 2004, now pending. The disclosure of this prior application is incorporated herein by reference in their entirety.

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

A good grip is desirable when wielding any hand-held object. A firm and comfortable grip is important when using many hand-held tools equipped with a handle or shaft, such as hammers and axes. Moreover, many sports require a player to grip a handle or shaft on a piece of sporting equipment, e.g. tennis, cycling, hockey, golf, etc. Golfers for example strive for consistency, and a comfortable, firm grip with proper finger placement is one of the keys to a consistent golf game. Nevertheless, the typical club grip used by many golfers does not promote a comfortable, firm grip or proper finger placement.

The typical golf club grip is a single-layer molded rubber grip that has a pre-determined thickness and durometer. The durometer or hardness of the club grip is important because a player's grip on the club will not feel secure if the grip is too hard or too soft. The right club grip "feel" varies widely among golfers. Most club grips, however, are only available in a few select levels of feel, such as soft, medium, or hard.

One way to improve club grip feel is to construct grips from multiple layers of material having different durometers. For example, Royal Precision's Multi-Density Grip employs a low durometer color compound layer over a hard black inner core layer. Royal Precision advertises that the soft outer layer provides a custom grip "feel," while the harder inner layer maintains stability by reducing torque and twisting at impact.

A similar design is used in existing cycle grips. One example of such grips are the ZyGo cycle grips made by A'ME. ZyGo grips have an inner-skeleton molded out of a hard rubber compound surrounded by a softer, tackier outer layer. A'ME advertises that the hard inner layer prevents torque between the handle bar and the rider's hands, while the softer outer layer provides increased grip feel.

Grips with multiple layers, similar to standard single-layer grips, are typically available only available in a few select layer durometers. Thus, existing multiple-layer grips are similarly limited in their level of club grip feel. In addition, multiple layer grips do not address the problem of proper finger placement. Without a physical guide on the club grip, it is often difficult for beginning and intermediate players to locate the proper hand placement on the club grip. Thus, many players vary the placement of their hands and fingers on the club from shot to shot. This is a major contributor to a golfer's lack of consistency on the golf course.

Most club grips lack any physical contours that could assist the golfer with proper and consistent finger placement when gripping the club. This is because the typical club grip is manufactured to comply with the rules of the United States Golf Association ("USGA"), which call for a club grip that is circular in cross section with no bulges or concavity. Nevertheless, there have been several attempts to improve the consistency in golf grip hand and finger placement through the addition of physical bulges or concavity in a golf grip.

For instance, U.S. Pat. No. 5,427,376 ("'376"), U.S. Pat. No. 5,480,146 ("'146"), and U.S. Pat. No. 6,540,621 ("'621") describe grips that are pre-shaped or pre-molded for a typical golfer's fingers. Indentations formed or molded onto the outer surface of the club grip guide the player's fingers and hands to the same location each time they grab the club. Yet, to accommodate the indentations and the bulges that indicate finger and hand placement, these grips are generally quite large and bulky. Another problem associated with the formed or molded indentations in these grips is that the bulges and concavities are obvious to other players, which can be a source of embarrassment for the player. Of course, these club grips also violate the USGA rules.

Furthermore, because the grips disclosed by '376, '146, and '621 references are molded or formed to accommodate the hands and fingers of a typical golfer, the grips are not tailored to the physical and style characteristics of the individual player. Thus, these grips are unable to accommodate the differences in golfers' hand sizes, finger lengths, grip styles (e.g., the overlapping grip, the 10-finger grip, the interlocking grip, etc.), or a combination thereof.

There have been attempts to offer a custom-mold club grip that improves the consistency of club grip finger placement to accommodate the unique physical characteristics of a player's hands. One such attempt by a company called Fit Grip requires that a player grip a pre-heated material forming the club grip for a period of approximately 30 seconds, during which time indents are formed in the soft grip material at precisely the points where the hands and fingers contact the grip. After the grip has cooled, the impression remains permanently molded in the club. The club grip is capable of being molded additional times if necessary.

Although the molding of the club grip produces contours custom-fitted to each golfer's hands, the resulting grip is still relatively large, obvious, and fails to conform to the USGA rules. An additional drawback is that the molded club grip must be fitted by a trained professional. Many avid golfers enjoy the work required to re-grip their clubs. By performing the re-grip themselves, golfers get a more intimate feel for their golf equipment and a greater sense of confidence when the equipment is used on the course.

It is an object of the present grips to provide an adjustable level of overall grip durometer, or "feel," in a single grip. It is another object of the present grips to instill confidence in the player by increasing the surface area of the grip in contact with the player's hands. It is yet another object of the present grips to provide a physical guide to assist in consistent and proper finger placement on a grip that is outwardly circular in cross section with no obvious bulges or concavity. It is an additional object of the present grips to provide a grip that may be custom-fitted by the player. Individual embodiments of the present grips may address some or all of these objectives.

These and other desirable characteristics of the present grips will become apparent in view of the present specification, including the claims and drawings. Although certain golf club grip examples are described in detail, the scope of this specification is not meant to limit its claims to only those examples shown. As such, those skilled in the art will appreciate that the conception, upon which this disclosure is based, may readily be utilized as a basis for the designing of other structures and methods for carrying out the several purposes of the present grips. It is important, therefore, that the claims be regarded as including such equivalent constructions insofar as they do not depart from the spirit and scope of the present grips.

BRIEF SUMMARY OF THE INVENTION

The present grips are directed to an improved gripping apparatus and method of use, including an improved golf club grip.

A preferred embodiment is, for example, a golf club grip that comprises an outer layer disposed around an inner layer. The inner layer has a higher durometer than the outer layer, which improves grip feel. The inner layer is also molded or moldable to substantially conform to the player's grip, thereby facilitating consistent finger placement. The outer layer maintains a substantially circular cross section when not gripped. Alternatively, the inner layer may be omitted and the shaft itself can be molded to substantially conform to a player's grip. In addition, a compression layer may be employed in addition to the outer layer to compress the outer layer to ensure that the outer layer maintains a circular cross section over the molded inner layer.

The preferred embodiment also may comprise a cavity disposed between an outer layer and an inner layer disposed around a shaft, or the shaft itself. The cavity may be expandable, and it may comprise a single space, or multiple subchambers. The subehambers may or may not be open to one another. The cavity may receive various substances, such as hardening agents, foam, or viscous liquids, to promote long or short-term conformity of the grip to a player's hands. Air or other gases may also be added or removed from the cavity to alter overall grip durometer, or feel. A valve may be provided for access to the cavity.

The preferred embodiment also may comprise an apparatus comprising a first material having a first durometer, and a second material having a second durometer. The first durometer is higher than the second durometer. The second material is disposed around the first material and positioned to substantially correspond to the player's finger placement, while the first material is positioned to correspond to areas of the grip that are not in contact with the player's fingers. When gripped, this arrangement guides the player's hands and fingers to the low durometer areas of the grip, which when gripped provide, in effect, concave impressions in the grip. When the grip is released, these low durometer areas return to their normal shape, giving the grip a substantially circular cross-section.

Alternatively, the durometer of the first material may be lower than the durometer of the second material. When gripped, this arrangement guides the player's hands and fingers to the areas of the grip where the low durometer inner material is the thickest.

The preferred embodiment may be manufactured as a wrap and wound around the club shaft. This wrappable grip may contain cavities, which may in turn contain other substances or materials to enhance the players grip on the club.

DETAILED DESCRIPTION OF THE INVENTION

Figure 1:
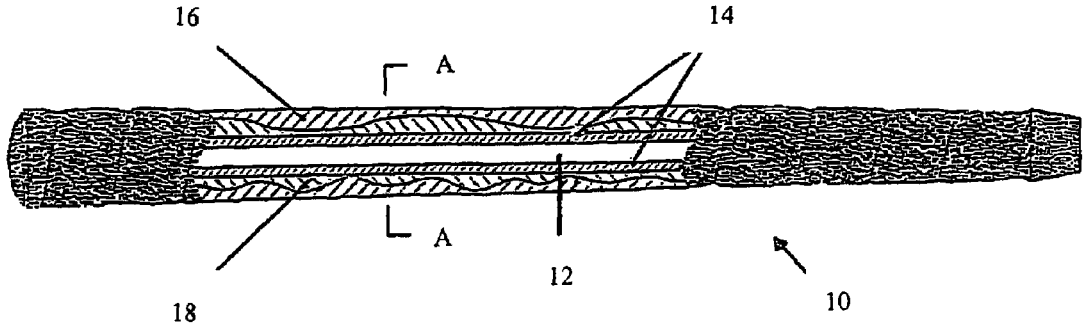
FIG. 1 is a cutaway view of a golf club grip, illustrating an outer layer disposed around a molded inner layer.

FIG. 1 represents a preferred embodiment in the form of a golf club grip 10, which includes an outer layer 16 and an inner section, in this case inner layer 18. Outer layer 16 is disposed around inner layer 18, which is in turn disposed around shaft 12 in contact with shaft walls 14.

The durometer of inner layer 18 is higher than the durometer of outer layer 16. For example, inner layer 18 may formed from rubber, while outer layer 16 is formed from closed cell foam. Outer layer 16 may also be formed from viscoelastic foam, in which case the indentations from the player's grip would remain visible in outer layer 16 for a short amount of time before outer layer 16 returned to a substantially circular cross section. This permits players to quickly find their proper grip by sight between separate swings performed in rapid succession.

Figure 2:
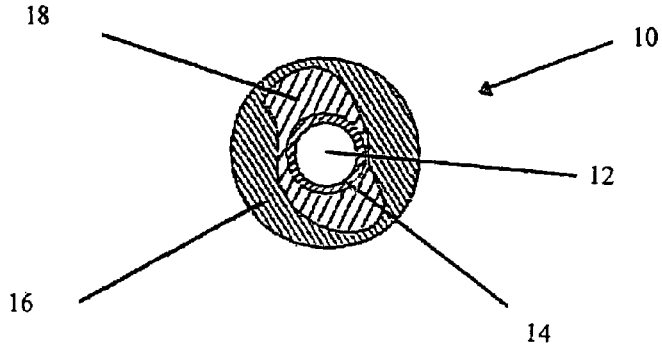
FIG. 2 is a cross section of the grip depicted in FIG. 1 along section line A-A, further illustrating the relationship of the inner and outer layers.

Inner layer 18 is shown molded to substantially conform to a player's grip, being thicker in non-contact areas sections of golf club grip 10 and thinner in contact areas. Thus, the player would be guided into a consistent gripping position at the thinnest portions of inner layer 18, or conversely at the thickest portions of outer layer 16. Meanwhile, when golf club grip 10 is not in use, outer layer 16 maintains a substantially circular cross section of golf club grip 10 while conforming to the contours of inner layer 18 as seen in FIG. 2.

Figure 3:
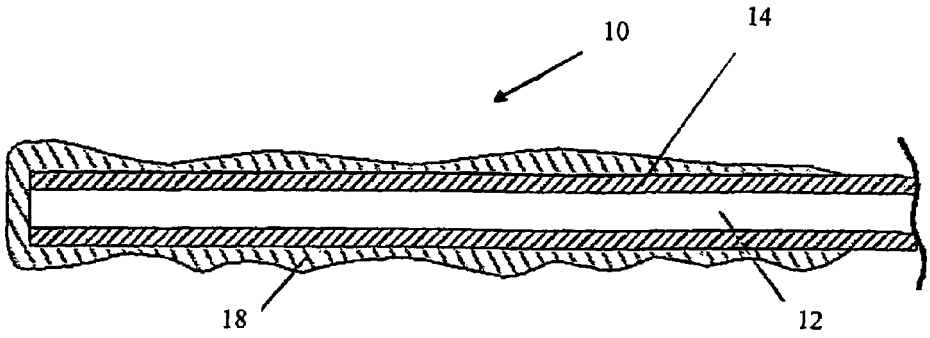
FIG. 3 is a cutaway view of the grip depicted in FIG. 1 showing the club shaft and molded inner layer.

FIG. 3 depicts molded inner layer 18 of golf club grip 10 disposed about club shaft 12. Outer layer 16 is not shown to emphasize the physical protrusions and concavities of inner layer 18 that serve to guide a player's grip into a firm and proper position.

Inner layer 18 can be pre-configured for an approximate fit, as discussed above, or inner layer 18 can be molded to custom-fit to the player's grip. In either case, outer layer 16 maintains a substantially circular cross section of golf club grip 10.

Figure 4:
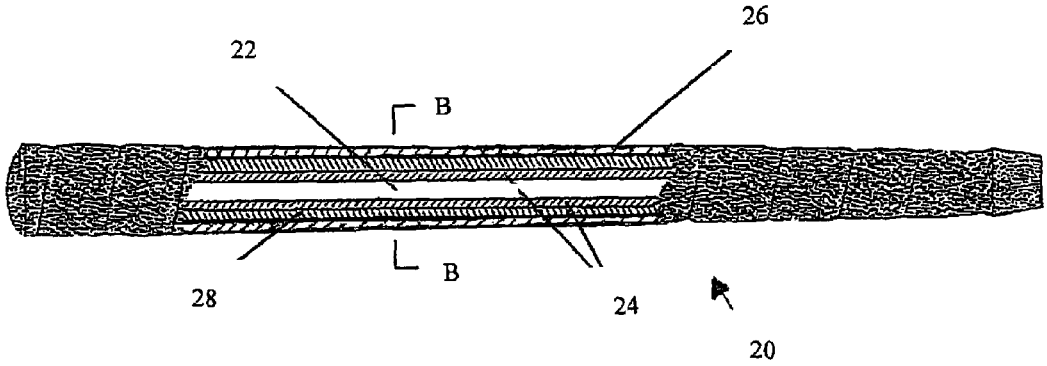
FIG. 4 is a cutaway view of a golf club grip illustrating a moldable inner layer disposed between the club shaft and an outer layer.

FIG. 4 depicts golf grip 20 having a moldable inner layer 28 disposed between an outer layer 26 and club shaft 22 with wall 24. Moldable inner layer 28 is comprised of a moldable material, such as clay. Other materials may be used as recognized by those skilled in the art. A custom-fit can be achieved by simply gripping un-molded golf club grip 20 with a firm and proper grip to conform outer layer 26 and inner layer 28 to the player's grip, and then releasing golf club grip 20. Upon release, moldable inner layer 28 remains substantially conformed to the player's grip, but outer layer 26 returns to a circular cross section.

In this configuration, the golfer can shape and re-shape the grip to his hands any number of times and the grip will retain the impressions of the golfer's hands until he/she desires to reshape the grip. For example, some advanced players will use different grips for certain specialty shots (draw, fade, punch, chip). If a specialty shot requiring a specific grip is desired, the golfer can simply rework the inner layer to the necessary shape.

Various durometers of the clay may be employed such that it may take considerable effort to reshape. In such instances, the grip would have a greater tendency to retain its shape over prolonged periods of time, e.g. weeks, months or even years.

Figure 5:
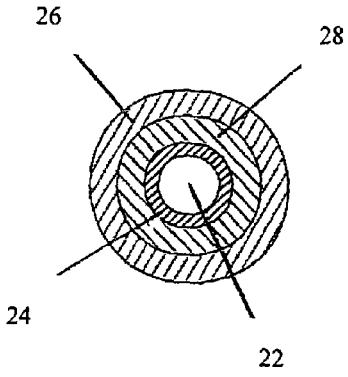
FIG. 5 is a cross section of the grip depicted in FIG. 4 along section line B-B before the inner layer is molded.
Figure 6:
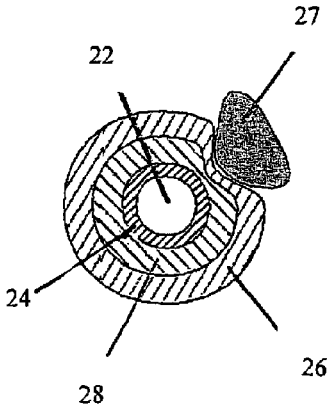
FIG. 6 is a cross section of the grip depicted in FIG. 4 along section line B-B as the inner layer is being molded.
Figure 7:
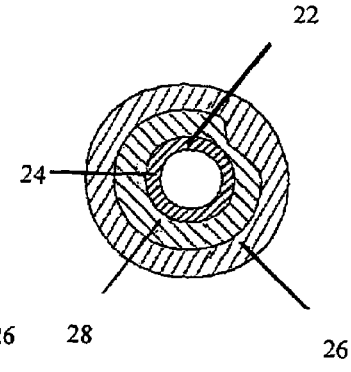
FIG. 7 is a cross section of the grip depicted in FIG. 4 along section line B-B after the inner layer is molded.

FIGS. 5 through 7 show in cross-section the sequence of molding moldable inner layer 28 along section line B-B. FIG. 5 is a cross section of golf grip 20 depicted in FIG. 4 along section line B-B shown before gripping golf grip 20. At this point, club shaft 22, moldable inner layer 28, and outer layer 26 all possess a substantially circular cross section.

FIG. 6 is a cross section of golf grip 20 depicted in FIG. 4 along section line B-B when gripped. When golf grip 20 is gripped, the players hands or fingers 27 compress both outer layer 26 and moldable inner layer 28. As depicted in FIG. 7, when golf grip 20 is released, outer layer 26 returns to a substantially circular cross section. Moldable inner layer 28, however, retains the impressions of the player's grip. The impressions will act to guide the player's grip into the same position the next time the player grips golf grip 20.

For a short term custom-fit, inner layer 28 of golf club grip 20 could be comprised of a closed cell foam, viscoelastic foam, or other material that regains its shape after deformation a short period of time later. This short-term custom-fit is particularly useful in golf because players may move their grip up or down the club depending on the distance to the pin or the desired ball trajectory, e.g. punch and chip shots. In this embodiment, inner layer 28 would have a lower durometer than outer layer 26. Thus, outer layer 26 and inner layer 28 maintain a substantially circular cross section until gripped, whereupon the impressions of the player's hands and fingers would be retained for a short time by inner layer 28. These impressions make inner layer 28 thicker when the grip is released and outer layer 26 returns to a substantially circular cross section. Inner layer 28 would gradually return to a circular cross section, but in the meantime the impressions of the player's grip serve to guide the player's grip into the original gripping position at the thicker portions of inner layer 28. This embodiment would be useful for making multiple shots in quick succession, as encountered on the driving range for example. For a pre-configured fit, a portion of club shaft may be used as the inner section in place of inner layer.

Figure 8:
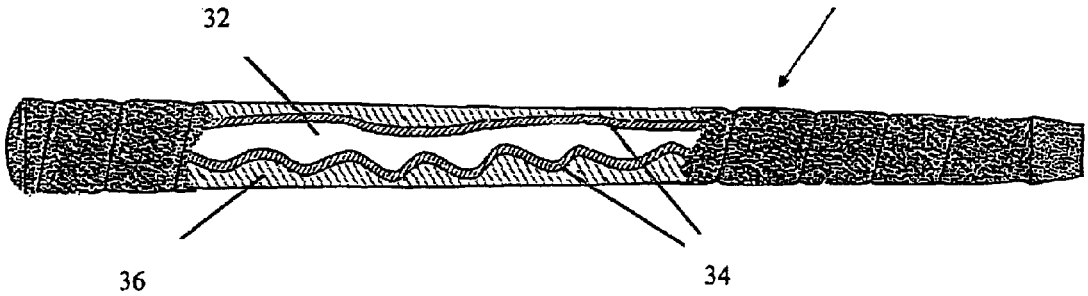
FIG. 8 is a cutaway view of a golf grip with aspects of the present invention, illustrating an outer layer disposed about a molded club shaft.

FIG. 8 depicts golf grip 30 having an outer layer 36 and a molded club shaft 32 with wall 34 in place of a molded inner layer. In this embodiment, a portion of club shaft 32 is pre-configured to substantially conform to a player's grip, while outer layer 36 maintains a substantially circular cross section of golf club grip 30. When golf grip 30 is gripped, the protrusions and concavities along the molded section of club shaft 32 act to guide the player's grip into a consistent and proper position.

Figure 9:
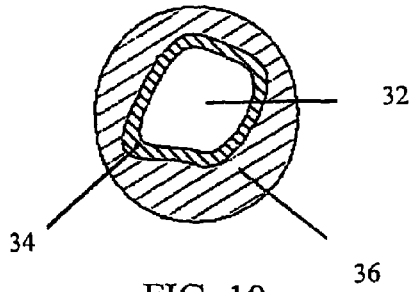
FIG. 9 is a cross section of the grip depicted in FIG. 8.

FIG. 9 shows a random cross section of golf grip 30 shown in FIG. 8. Molded shaft wall 34 has a higher durometer than outer layer 36. Thus, when golf grip 30 is gripped by the player, outer layer 36 will compress under the player's grip to roughly conform to the contours of molded shaft wall 34. When released, outer layer 36 of golf grip 30 will return to a substantially circular cross section quickly, or over time, depending on the material used to form outer layer 36.

Figure 10:
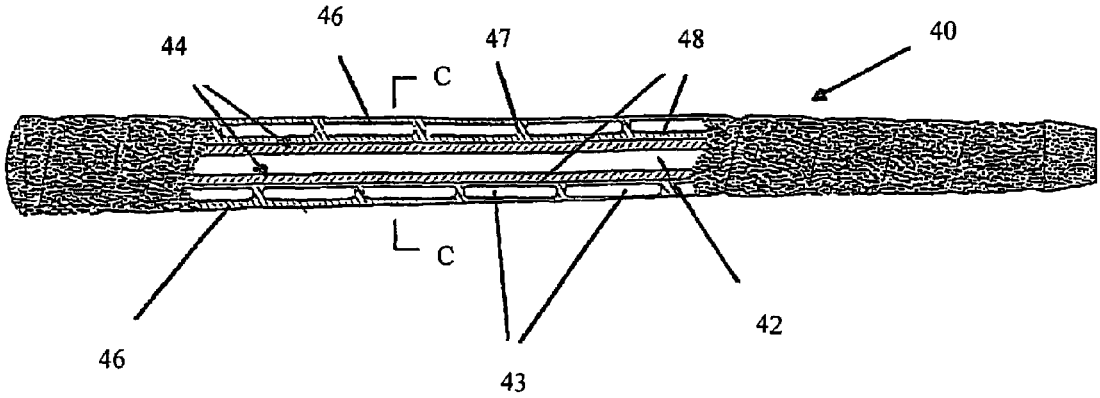
FIG. 10 is a cutaway view of a golf club grip, illustrating a cavity comprising sub-chambers disposed between an outer layer and an inner layer.

FIG. 10 depicts yet another embodiment of a golf club grip 40. In this embodiment, a cavity comprised of a series of sub-chambers 43 is located between outer layer 46 and an inner layer 48, which is disposed around shaft 42 with shaft wall 44. The addition of inner layer 48 facilitates the adhesion of golf club grip 40 to shaft 12, and seals sub-chambers 43 tightly. Connection points 47 operably connect inner layer 48 to outer layer 46. Sub-chambers 43 may be in communication with one another, or constitute completely separate chambers.

Figure 11:
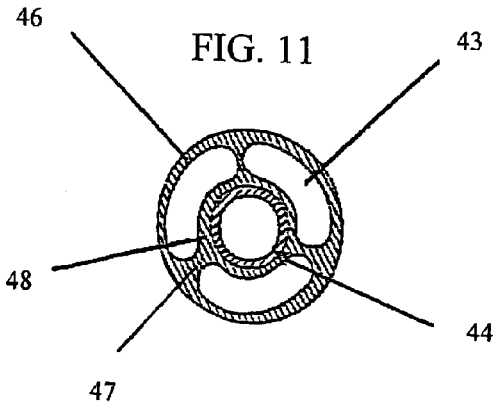
FIG. 11 is a cross section of the grip depicted in FIG. 10 along section line C-C, illustrating a landing and the sub-chambers between the inner and outer layers.

FIG. 11 depicts a cross section of golf grip 40 of FIG. 10 taken at section line C-C. Subchambers 43 function to lower the overall durometer of golf grip 40 as compared to areas of golf grip 40 over connection points 47. Thus, the player's grip is guided to the regions of overall low durometer located over subchambers 43, which provides a consistent grip along the length of golf grip 40, even if players move their grip up or down the length of golf grip 40. FIG. 11 shows three sets of sub-chambers 43 located between outer layer 46 and inner layer 48, but the configuration of sub-chambers 43 may vary, and the use of three sub-chambers 43 in this embodiment is meant only as an example.

To achieve a desired grip feel, the firmness of golf club grip 40 over sub-chambers 43 in between landings 47 can be adjusted by adding a substance to sub-chambers 43. This substance could be added by the player or the manufacturer. For example, a viscous liquid, such as a gel, could be introduced into sub-chambers 43 to increase the feel of golf club grip 40. The gel would conform to the hand impressions of the golfer and thus provide the desired increased surface area for the golfer's hands. This has the desired effect of providing increased "feel" for the golfer when taking a swing at the ball, yet the grip may then revert back to its circular cross section shortly following release of the grip. The sequence of events is depicted in FIGS. 12 through 15.

Figures 12, 13, 14, 15:
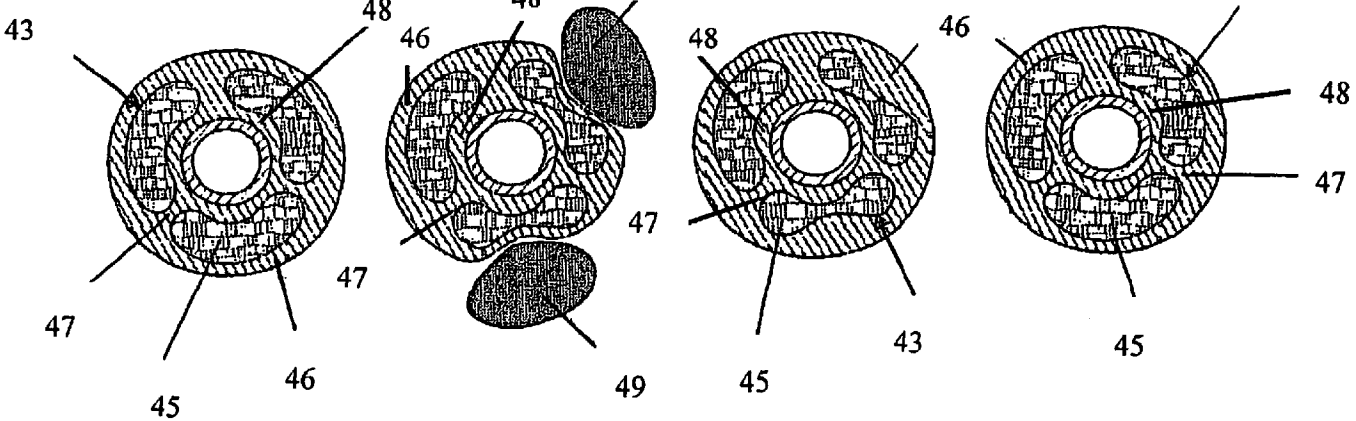
FIG. 12 is a cross section of the grip depicted in FIG. 10 along section line C-C with a viscous gel in the sub-chambers before gripping.
FIG. 13 is a cross section of the grip depicted in FIG. 10 along section line C-C with a viscous gel in the sub-chambers during gripping.
FIG. 14 is a cross section of the grip depicted in FIG. 10 along section line C-C with a viscous gel in the sub-chambers shortly after the grip is released.
FIG. 15 is a cross section of the grip depicted in FIG. 10 along section line C-C with a viscous gel in the sub-chambers a substantial time after the grip is released.

FIG. 12 depicts the cross section of FIG. 10 along section line C-C containing a viscous gel 45. In FIG. 13, a player grips golf grip 40 and fingers 49 are depicted compressing outer layer 46 and gel-containing subchambers 43 under fingers 49. Inner layer 48 retains a substantially circular cross section.

FIG. 14 depicts golf grip 40 immediately after the player's grip is released. Outer layer 46 has reverted to its substantially circular cross section, but compressed gel-containing sub-chambers 43 retain the impression of the player's fingers 49. Over time, gel-containing subchambers 43 may revert to substantially their original configuration as shown in FIG. 15.

Depending on the viscosity of the gel 45 and the internal structure of golf grip 40, the time it takes for gel-containing subchambers 43 to revert back to substantially their original configuration may be fractions of a second to several minutes. If gel-containing sub-chambers 43 are in fluid communication, there will be a relocation or shifting of the gel 45 away from the gripped areas. Alternatively, isolated sub-chambers 43 containing with gel 45 will limit the gel from relocating to other areas of golf grip 40.

Figure 16:
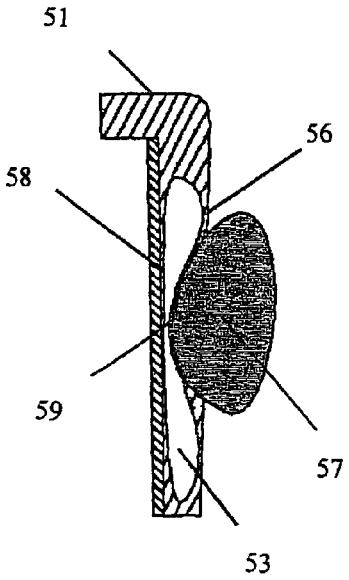
FIG. 16 is a cross section of a golf club grip illustrating an unpressurized subchamber disposed between an outer layer and an inner layer during gripping.
Figure 17:
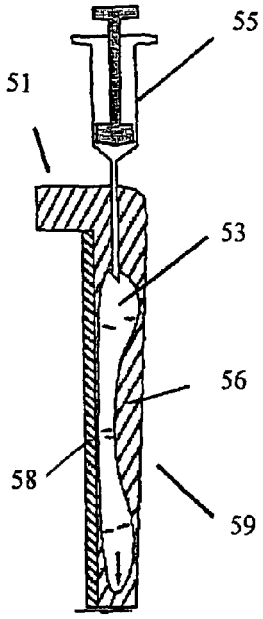
FIG. 17 is a cross section of the grip depicted in FIG. 16 illustrating a pump pressurizing the subchamber.
Figure 18:
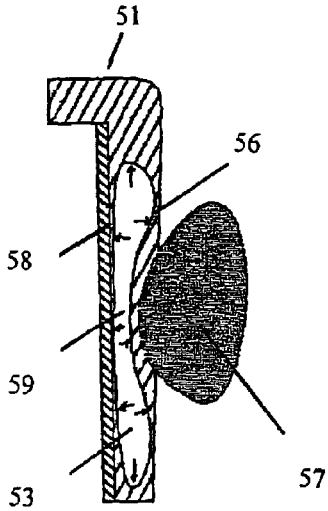
FIG. 18 is a cross section of the grip depicted in FIG. 16 illustrating a pressurized cavity disposed between an outer layer and an inner layer during gripping.

Alternatively, an adjustable firmness grip can be achieved by pressurizing or depressurizing sub-chambers to provide a custom feel in accordance with FIGS. 16 through 18. In this embodiment, a cavity or sub-chambers 53 within a golf club grip can be placed under increased or reduced air pressure by the player. As discussed previously, regions of a golf grip containing a cavity or subchambers 53 may present an overall lower golf grip durometer than regions of a golf grip without such a cavity or subchambers 53. Thus, when a player's finger 57 compresses the golf grip over a cavity or subchamber 53, golf grip conforms to finger 57 and outer layer 56 moves substantially towards inner layer 58 in region 59 as shown in FIG. 16. However, depending on the strength of the player's grip, the "feel" created by this overall durometer may seem too soft.

In FIG. 17, an air pump 55 is shown injecting air into subchamber 53. Pressure acting on the walls of subchamber 53 is depicted by arrows. By pumping more or less air into the inner chambers of the grip using an air pump 55, the overall durometer of the golf grip over subchamber 53 is increased, much like pumping up a tire on a bicycle.

Thus, when the player desiring a firmer grip feel grips the pressurized golf grip shown in FIG. 18, the pressure applied by player's finger 57 is opposed by the increased air pressure in subchamber 53. As a result, the player perceives a firmer feel and outer layer 56 does not move as far into subchamber 53 towards inner layer 58 in region 59.

In this manner, the overall grip can have a lower or higher overall durometer, depending entirely on the desires of the individual golfer. Higher inner pressure in the inner chamber results in a harder grip, lower pressure results in a softer grip. Therefore, depending on the circumstances surrounding a particular shot, the golfer can adjust the grip to his preferences. A simple valve (not shown), preferably on the heel 51 of the golf grip so as not to interfere with the circular cross section, may be employed as the pump needle insertion point for the adjustment of the inner air pressure within the grip. The valve itself need be no more complex than the self-sealing valves found on typical inflatable basketballs, soccer balls and the like.

Figure 19:
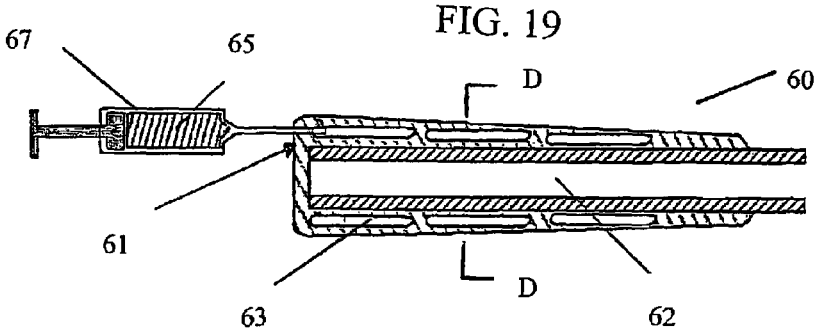
FIG. 19 is a cutaway view of a golf club grip illustrating a syringe containing a hardening agent positioned in a cavity comprised of subchambers.
Figure 20:
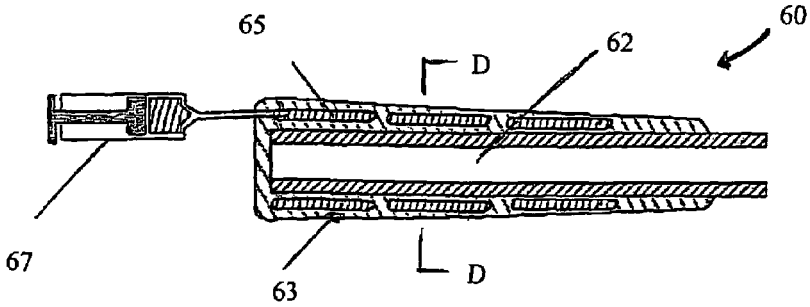
FIG. 20 is a cutaway view of the grip depicted in FIG. 19 after a hardening agent has been injected into the subchambers.

Yet another preferred embodiment is shown in FIGS. 19 and 20. This embodiment involves introducing a hardening agent 65 into sub-chambers 63 to facilitate the custom molding of golf club grip 60 to substantially conform to a player's grip. As shown in FIG. 19, a syringe 67 containing a hardening agent 65 is inserted into sub-chambers 63. Hardening agent 65 is then injected into subchambers 63 as depicted in FIG. 20.

Figure 21:
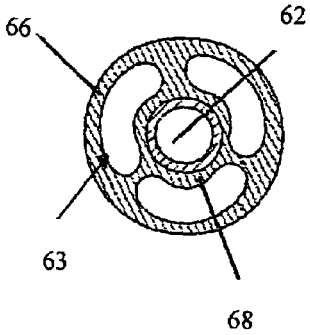
FIG. 21 is a cross section of the grip depicted in FIG. 19 along section line D-D before the hardening agent is introduced.
Figure 22:
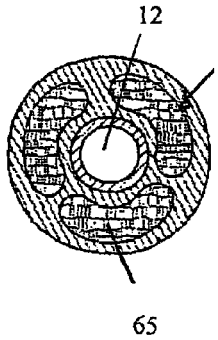
FIG. 22 is a cross section of the grip depicted in FIG. 20 along section line D-D after the hardening agent is introduced.

FIGS. 21 through 24 show the sequence of events relating to this embodiment. A representative cross section, along section line D-D, of golf grip 60 depicted in FIG. 19 is shown in FIG. 21. Hardening agent 65 has not yet been introduced into subchambers 63. FIG. 22 shows a representative cross section, along section line D-D, of golf grip 60 depicted in FIG. 20 after hardening agent 65 has been injected into sub-chambers 63.

Figure 23:
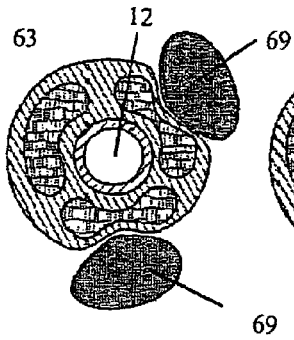
FIG. 23 is a cross section of the grip depicted in FIG. 20 along section line D-D after the hardening agent is introduced during gripping.
Figure 24:
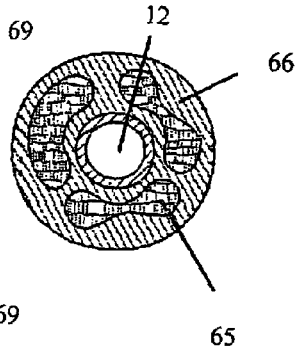
FIG. 24 is a cross section of the grip depicted in FIG. 20 along section line D-D after the hardening agent has hardened and the grip is released.

In FIG. 23, the player has gripped golf grip 60 with the proper grip and two fingers 69 are shown compressing outer layer 66 into subchamber 63 to substantially conform golf grip 60 to the player's grip. The player must now hold this grip until hardening agent 65 hardens to a pre-determined durometer based on the hardening agent used. FIG. 24 shows the cross section, along section line D-D, of golf grip 60 after hardening agent 65 has hardened to a predetermined durometer and golf grip 60 has been released. Outer layer 66 is preferably a low durometer, flexible material, such as an open cell foam. Thus, when the players release their grip on golf club grip 60 after molding sub-chambers 63, outer layer 66 can then largely spring back to maintain a substantially circular cross section over molded sub-chambers 63. Hardened sub-chambers 63, however, are permanently set with the impression of the player's grip in the proper position. As shown, some subchambers 63 may not be compressed depending on their location relative to the player's grip.

This custom molding using a hardening agent 65 results in the desired maximum surface area of the grip in contact with the golfer for the most amount of "feel." Hardening times will depend on the hardening agent used. A compressive layer (not shown), such as a tacky tape, can employed to compress outer layer 66 and ensure a circular cross section over hardened, molded sub-chambers 63. Sub-chambers 63 may be initially filled with an open-celled foam, or other porous material that will accept the hardening agent.

If the golfer desires the hardest or highest durometer inner core, hardening agent 65 may be a type of epoxy resin. Various epoxies may be appropriate. For example, epoxies blended with lightweight "microspheres" provides the typical hardness of epoxy, yet are much less dense and therefore lighter in weight than epoxies without microspheres. Microspheres are essentially hollow air-filled particles that take up space within the hardening matrix without adding any additional weight. The microsphere replaces its volume with air as opposed to the parent substrate. Alternatively, various polyurethanes with predetermined durometers can be used. Typical durometers for these materials range from 40 Shore A hardness to 72 Shore D. Polyurethanes may also be filled with microspheres to reduce the density or weight of the filler within the grip.

Figure 25:
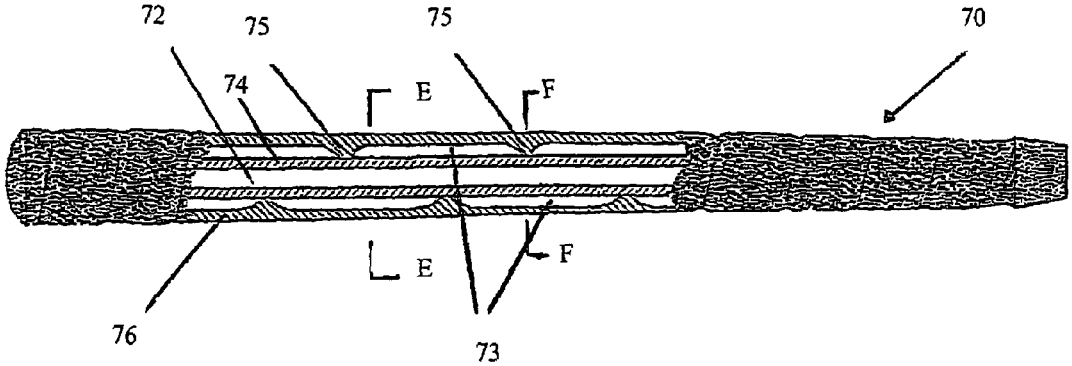
FIG. 25 is a cutaway view of a golf club grip illustrating a cavity comprised of subchambers disposed between an outer layer and the club shaft.

Another preferred embodiment of golf club grip 70 is depicted in FIG. 25. A cavity comprising sub-chambers 73, is located between outer layer 76 and shaft walls 74 of golf club grip 70. Similar to the embodiment of the golf grip 40 disclosed in FIG. 10, sub-chambers 73 may be in communication with one another, or constitute completely separate chambers. Unlike the embodiment of the golf grip 40 disclosed in FIG. 10, however, there is no inner layer such as inner layer 48. Instead, outer layer 76 is operably connected with shaft walls 74 at landings 75 within golf club grip 70.

In this embodiment, the player's grip would be guided into position over sub-chambers 73 in between landings 75. In other words, the player's grip would gravitate to areas of lower overall golf grip durometer. Much like the embodiment shown in FIG. 10, the player's fingers would be guided into position over sub-chambers 73 in between landings 75.

Figure 26:
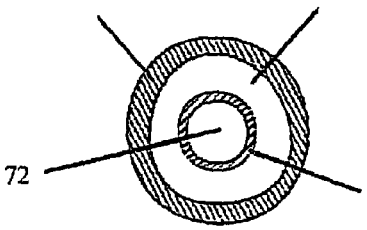
FIG. 26 is a cross section of the grip depicted in FIG. 25 along section line E-E, illustrating the relationship of the cavity to the shaft and outer layer.
Figure 27:
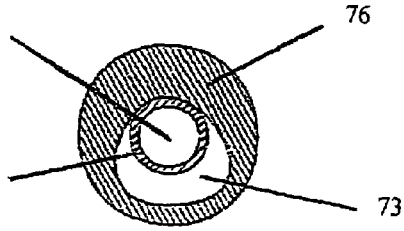
FIG. 27 is a cross section of the grip depicted in FIG. 25 along section line F-F, illustrating the relationship of the cavity to the shaft and outer layer at a point including an outer layer landing.

FIG. 26 illustrates a cross section of golf club grip 70 of FIG. 25 taken along section line E-E, wherein sub-chambers 73 extend around the entire circumference of club shaft 72. FIG. 27, on the other hand, illustrates a cross section of golf club grip 70 of FIG. 25 taken along section line F-F, wherein subchamber 53 is interrupted by a landing 75 extending from outer layer 76 to shaft wall 74. These varying areas of overall high and low durometer indicate proper grip placement.

Several other embodiments relate to the structure of FIG. 25, but are not shown as they are described in relation to the embodiment depicted in FIG. 10. For instance, the firmness of golf club grip 70 in areas over sub-chambers 53 in between landings 75 can be customized by adding a viscous liquid, such as a viscous gel, to sub-chambers 73 to achieve the desired grip feel. Alternatively, an adjustable firmness grip can be achieved by pressurizing or depressurizing sub-chambers 73 to provide a custom feel. Finally, golf club grip 70 can be custom molded to substantially conform to a player's grip by introducing a hardening agent, such as an epoxy or polyurethane, into sub-chambers 73, gripping golf club grip 70 until the hardening agent hardens, and then releasing.

Figure 28:
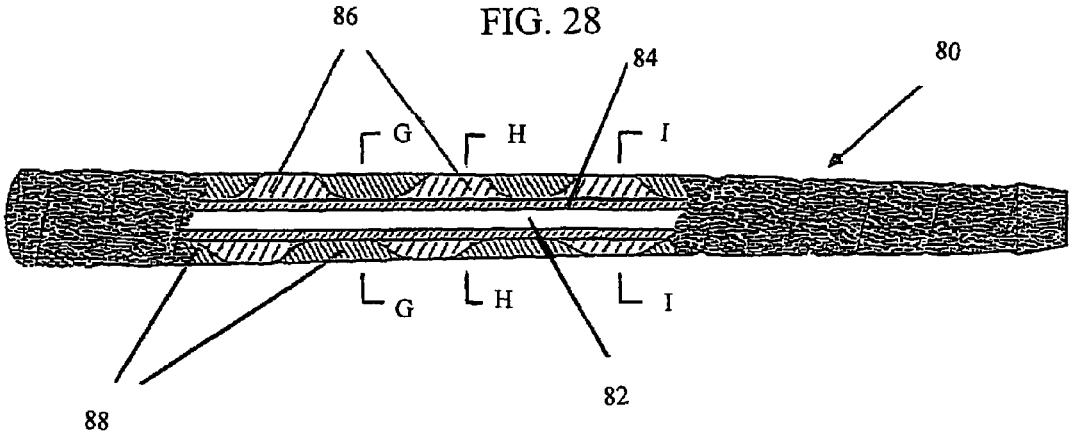
FIG. 28 is a cutaway view of a golf club grip, illustrating a shaped low durometer layer and a shaped high durometer layer disposed around the club shaft.

FIG. 28 illustrates still another embodiment of golf club grip 80 comprising alternating layers of a high durometer material 88 and a low durometer material 86 disposed around shaft 82. As in previous examples, the player's grip will be guided into a consistent gripping position corresponding to the low durometer layers 86 alternating between high durometer layers 88. The materials used in golf club grip 80 may be high and low durometer foams, rubber, or other suitable materials.

Figure 29:
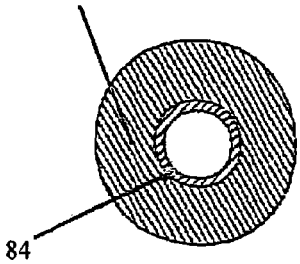
FIG. 29 is a cross section of the grip depicted in FIG. 28 along section line G-G, representing an area of the grip with a high durometer layer.
Figure 30:
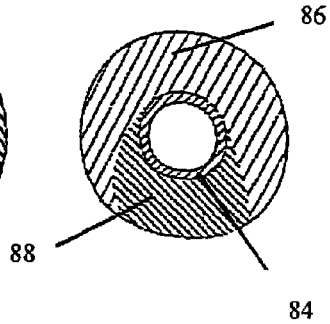
FIG. 30 is a cross section of the grip depicted in FIG. 28 along section line H-H, representing an area of the grip including high and low durometer layers.
Figure 31:
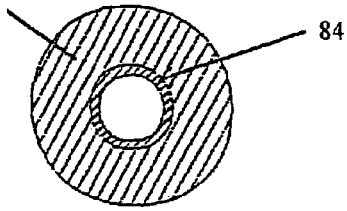
FIG. 31 is a cross section of the grip depicted in FIG. 28 along section line I-I, representing an area of the grip with a low durometer layer.

FIGS. 29 through 31 further illustrate the effect of alternating layers of high durometer material 88 and low durometer material 86 in golf club grip 80. In FIG. 29, the illustrated cross-section of golf club grip 80, along section line G-G consists of high durometer layer 88 surrounding shaft 82. In FIG. 30, another cross-section of golf club grip 80 is illustrated, along section line H-H, that includes both high durometer layer 88 and low durometer layer 86. Finally, FIG. 31 illustrates a section of golf club grip 80 consisting of low durometer layer 86 around shaft 82. Again, as discussed previously in relation to other embodiments, the player's grip is guided to the low durometer sections of golf grip 80.

Figure 32:
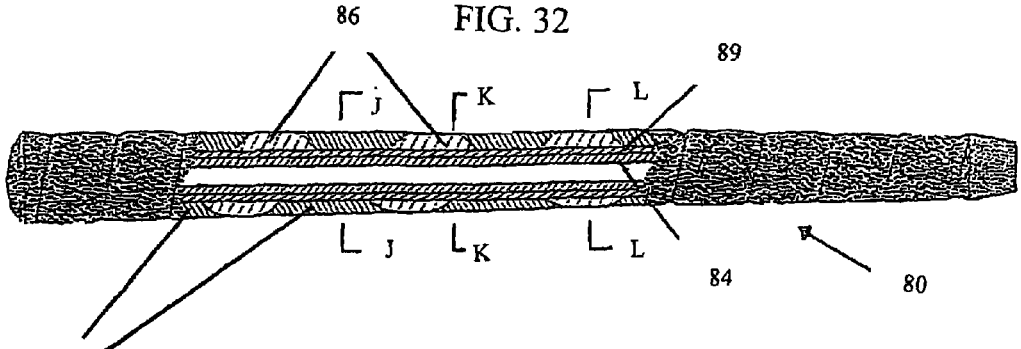
FIG. 32 is a cutaway view of a golf club grip, illustrating a shaped low durometer layer and a shaped high durometer layer disposed around an inner layer.

FIG. 32 illustrates another embodiment of golf club grip 80 comprising the previously discussed alternating layers of a high durometer material 88 and a low durometer material 86, but now disposed around an inner layer 89, which is in turn disposed around shaft 82. Inner layer 89 may facilitate the bonding of golf club grip 80 to shaft walls 84. Otherwise, this embodiment is functionally similar to the embodiment depicted in FIG. 28, i.e. the player's grip will be guided into a consistent gripping position corresponding to the low durometer layers 86 between high durometer layers 88.

Figure 33:
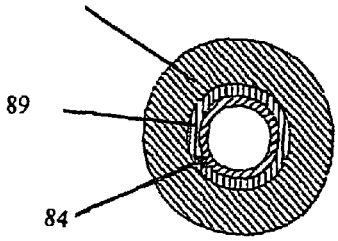
FIG. 33 is a cross section of the grip depicted in FIG. 32 along section line J-J, representing an area of the grip with a high durometer layer disposed around the inner layer.
Figure 34:
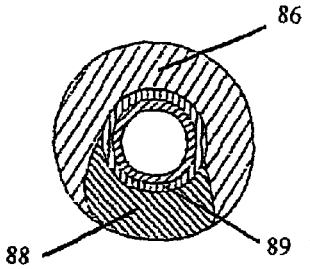
FIG. 34 is a cross section of the grip depicted in FIG. 22 along section line K-K, representing an area of the grip including high and low durometer layers disposed around the inner layer.
Figure 35:
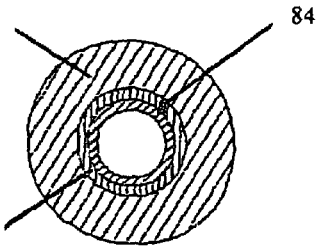
FIG. 35 is a cross section of the grip depicted in FIG. 22 along section line L-L, representing an area of the grip with a low durometer layer disposed around the inner layer.

FIGS. 33 through 35 further illustrate the alternating layers of high durometer material 88 and low durometer material 86 in golf club grip 80. In FIG. 33, the illustrated section of golf club grip 80, along section line J-J, consists of high durometer layer 88 surrounding inner layer 89. In FIG. 34, another section of golf club grip 80 is illustrated, along section line K-K, that includes both high durometer layer 88 and low durometer layer 86 around inner layer 89. FIG. 35 illustrates a section of golf club grip 80, along section line L-L, consisting of low durometer layer 86 around inner layer 89. Again, the player's grip is guided into the low durometer sections around inner layer 89 of golf grip 80.

Figure 36:
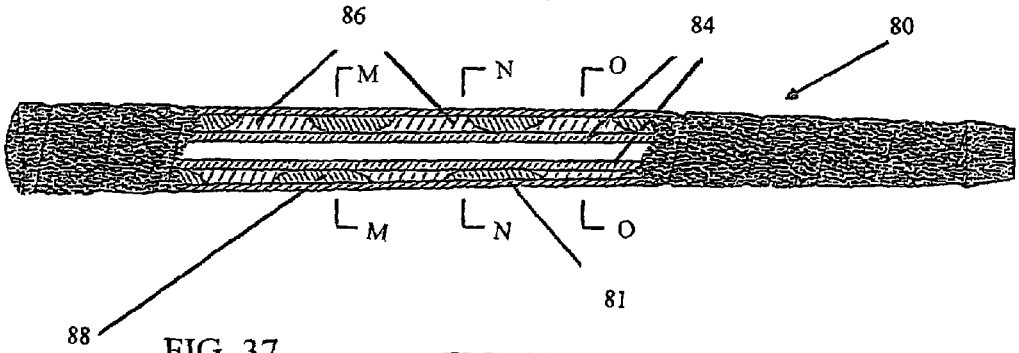
FIG. 36 is a cutaway view of a golf club grip, illustrating a shaped low durometer layer and a shaped high durometer layer disposed between an outer layer and the club shaft.

FIG. 36 illustrates yet another variation of the embodiment of golf club grip 80 depicted in FIG. 28. In this embodiment, the previously discussed alternating layers of a high durometer material 88 and a low durometer material 86 are disposed between an inner layer 89 and an outer layer 81. Inner layer 89 is disposed around shaft 82 and may facilitate the bonding of golf club grip 80 to shaft walls 84. Outer layer 81 may be formed from a tacky, high friction film or coating and may improve grip feel by increasing friction between the player's hands and golf club grip 80. Otherwise, this embodiment is again similar to the embodiment depicted in FIG. 28, i.e. the player's grip will be guided into a consistent gripping position corresponding to the low durometer layers 86 between high durometer layers 88.

Figure 37:
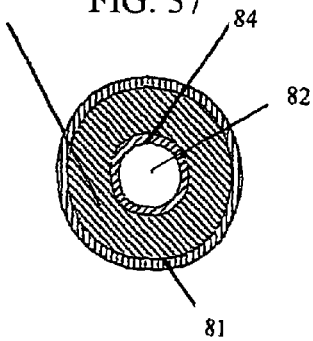
FIG. 37 is a cross section of the grip depicted in FIG. 36 along section line M-M, representing an area of the grip with a high durometer layer disposed between the outer layer and the club shaft.
Figure 38:
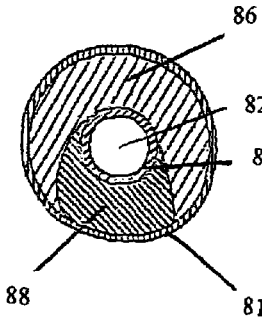
FIG. 38 is a cross section of the grip depicted in FIG. 36 along section line N-N, representing an area of the grip including high and low durometer layers disposed between the outer layer and the club shaft.
Figure 39:
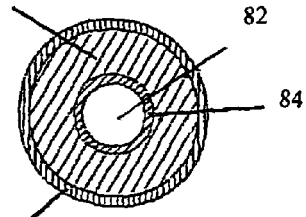
FIG. 39 is a cross section of the grip depicted in FIG. 36 along section line O-O, representing an area of the grip with a low durometer layer disposed between the outer layer and the club shaft.

FIGS. 37 through 39 further illustrate the relationship of the multiple layers employed in golf club grip 80 along various sections of golf club grip 80. In FIG. 37, the illustrated section of golf club grip 80, along section line M-M consisting of outer layer 81 around high durometer layer 88, which in turn surrounds shaft 82. In FIG. 38, another section of golf club grip 80 is illustrated, along section line N-N, consisting of outer layer 81 around both high durometer layer 88 and low durometer layer 86, which in turn surrounds shaft 82. FIG. 39 illustrates a section of golf club grip 80, along section line O-O, consisting of outer layer 81 around low durometer layer 86, which in turn surrounds shaft 82. Again, the player's grip is guided into the low durometer sections between high durometer sections.

Yet another variation of golf grip 80 as disclosed by FIGS. 28, 32, and 36 includes subchambers located in the high durometer sections of golf grip 80 (not shown). These subchambers can be pressurized as described in relation to FIGS. 16 through 18 to increase the feel of golf grip 80 by customizing the overall durometer of high durometer layer 88. This customization makes for a more secure grip with a better feel.

Figure 40:
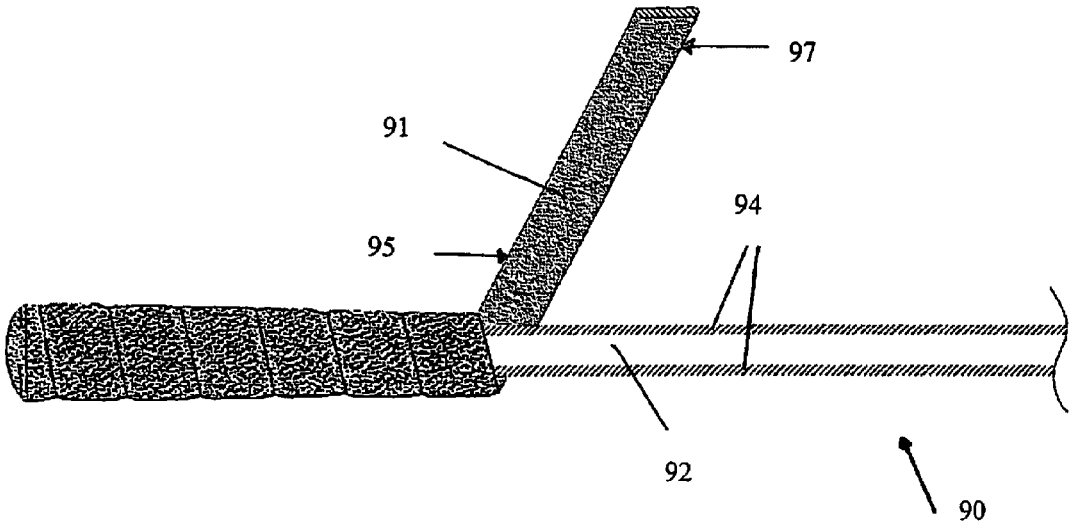
FIG. 40 is a side view of a golf club grip illustrating a wrap grip as it is wrapped around the club shaft.

Yet another preferred embodiment relates to the structure of a golf grip in relation to the method for installing the grip. For example, FIG. 40 shows golf grip 90 configured as a wrappable grip 91 comprising a roll of material constructed in accordance with the various embodiments described previously, e.g., containing various layers, a cavity or subchambers, etc., being installed on a club shaft 92. Wrappable grip 91 has a first edge 95 along a long side of wrappable grip 91, and a second edge 97 on the opposite side of wrappable grip 91.

Figure 41:
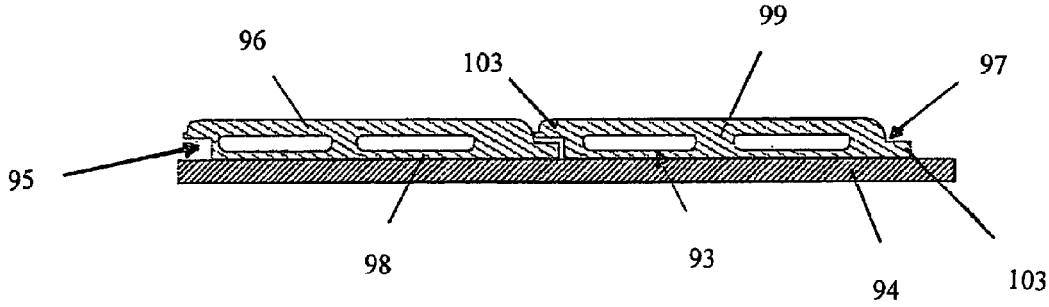
FIG. 41 is a cutaway view of the wrap grip of FIG. 40 illustrating a cavity comprised of subchambers disposed between an outer layer and an inner layer.

As shown in FIG. 41, first edge 95 and second edge 97 of wrappable grip 91 may include interlocking tabs 103 to ensure a proper, close-fitting installation. The particular wrappable grip 91 depicted in FIG. 41 has a cavity comprised of subchambers 93 disposed between an outer layer 96 and an inner layer 98. Connection points 99 connect outer layer 96 and inner layer 98 and serve to guide the player's grip to areas of lower overall durometer, e.g., areas of wrappable grip 91 over subchambers 93.

Figure 42:
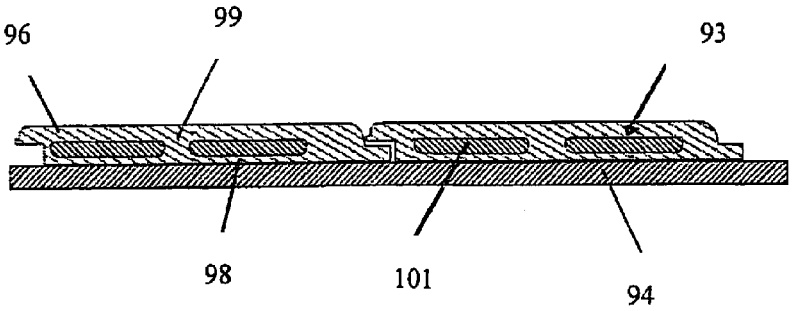
FIG. 42 is a cutaway view of the wrap grip of FIG. 40 showing a moldable substance in the subchambers.
Figure 43:
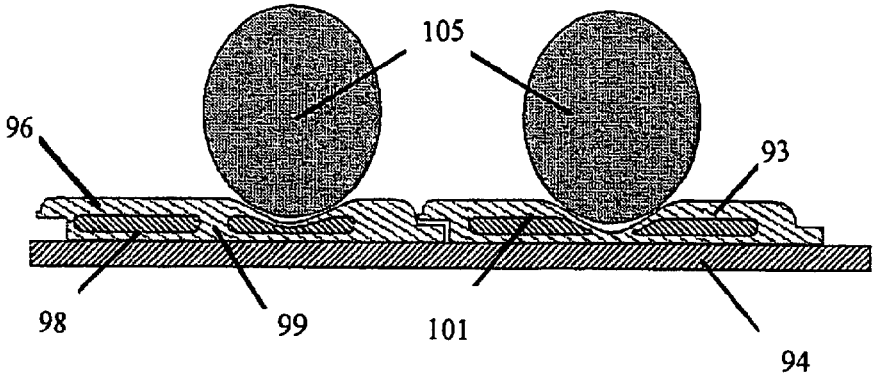
FIG. 43 is a cutaway view of the wrap grip of FIG. 42 during gripping showing the molded subchambers.
Figure 44:
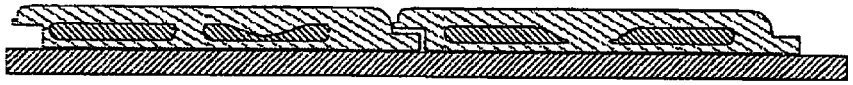
FIG. 44 is a cutaway view of the wrap grip of FIG. 42 showing the molded subchambers after the grip is released.

Wrappable grip 91 may also be configured such that subchambers 93 contain a viscous gel 101, as shown in FIG. 42. Once installed, impressions of the player's grip are stored by the gel-containing subchambers 93 of wrappable grip 91. FIG. 43 shows wrap grip 91 employing gel-containing subchambers 93 being gripped by a player. Player's fingers 105 compress outer layer 96, connection points 99, or gel-containing subchambers depending on the location of the player's grip. Once released, outer layer 96 of wrappable grip 91 returns to its substantially circular cross section, but gel-containing subchambers 93 store the impression of the player's grip for a time, as depicted in FIG. 44. The length of time the impressions are stored will vary with the properties of gel 101 and the structure of wrappable grip 91. Alternatively, a hardening agent may be employed to store the impressions of the player's grip permanently (not shown). This configuration may require injection or activation of the hardening agent before performing the actions generally depicted in FIGS. 43 and 44.

As appropriate, a kit may be provided to the player that provides all the necessary materials to regrip his clubs with the desired grips. For instance, the kit may include an air pressure-adjustable grip, the standard double-sided tape and solvent typically used to regrip golf clubs, and a small air pump and pressure gauge that would fit within the golfer's bag (not shown).

Figure 45:
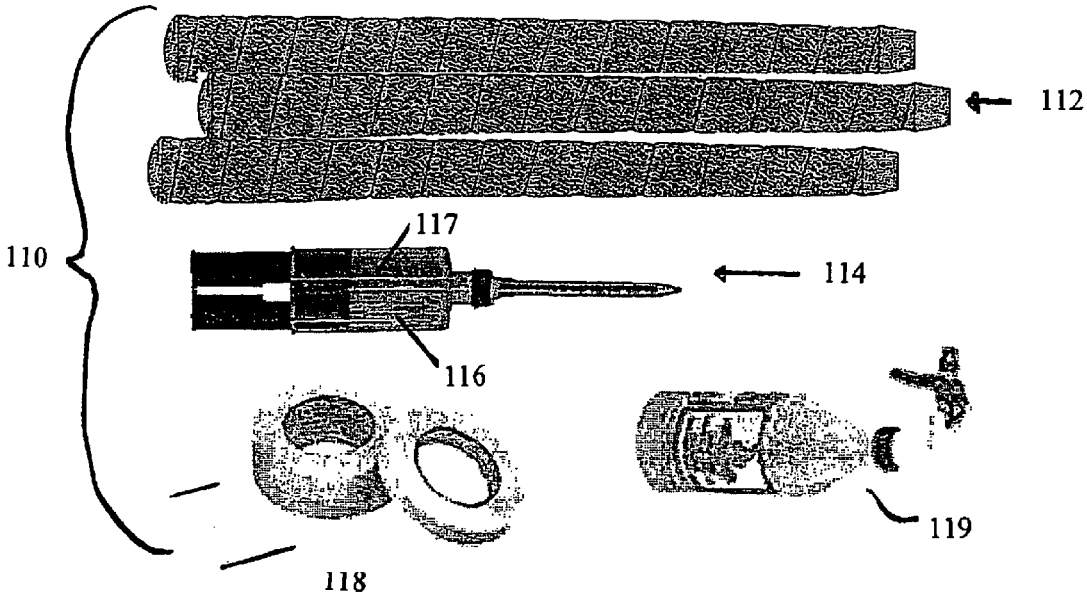
FIG. 45 is a kit illustrating golf club grips, an epoxy injector, tape, and solvent.

Alternatively, the kit may include filling materials, if required. For instance, if the grip is to be filled with a hardening material such as the polyurethanes, the kit 110 may include grips 112, standard double-sided tape 118 and solvent 119, and a pre-filled syringe 114 with the desired materials in the proper volume. If the filler material is a two part system, such as with epoxies and urethanes, the resin 116 and the catalyst hardener 117 may be provided in individual syringes or a single syringe that mixes the two parts upon injection into the grip as shown in FIG. 45. Alternatively, the grip may have the two part system pre-filled within its hollow chambers such that, after the grip has been installed, the golfer can mix the two parts by applying pressure to different areas of the grip, much in the same way that glow-in-the-dark light sticks are entirely self-contained (not shown). This would provide the added convenience of having the grip pre-filled and pre-measured, ready for installation.

While the present golf club grip has been described in connection with one or more preferred embodiments, it will be understood that the present golf club grip is not limited to those embodiments. On the contrary, the present golf club grip includes all alternatives, modifications, and equivalents as may be included within the spirit and scope of the appended claims.

It should also be understood that the translation of the present technique to other hand held equipment equipped with a handle or shaft should be readily apparent to those skilled in the art. By way of example, and not limitation, the present apparatus and methods may translate to certain tools and sporting equipment. Therefore, although the embodiments are described in the context of a golf club grip, the various applications of the present apparatus and methods are not so limited.

It is also to be realized that the optimum dimensional relationships for the parts of the present golf club grip, including variations in size, materials, shape, form, function and manner of operation, assembly and use, are deemed readily apparent and obvious to one skilled in the art, and all equivalent relationships to those illustrated in the drawings and described in the specification are intended to be encompassed by the present golf club grip.

Therefore, the foregoing is merely illustrative of the principles of the invention. Since numerous modifications and changes will readily occur to those skilled in the art, it is not desired to limit the golf club grip to the exact construction and operation shown and described, and accordingly, all suitable modifications and equivalents may be resorted to, falling within the scope of the invention.

The invention claimed is:

1. A golf club grip comprising:

an inner section; and an outer layer, the outer layer being disposed around the inner section;

wherein the inner section has a higher durometer than the outer layer;

wherein a portion of the inner section is molded to substantially conform to a player's grip when an adjacent portion of the outer layer is gripped by the player, the gripped portion of the outer layer substantially conforms to the player's grip when gripped; and the molded portion of the inner section maintains a shape that substantially conforms to the player's grip while the gripped portion of the outer layer returns to a substantially circular cross section when the gripped portion of the outer layer is released from the player's grip.

2. The golf club grip of claim 1, wherein the inner section comprises a layer of material disposed around a golf club shaft.

3. The golf club grip of claim 1, wherein the inner section comprises a portion of a golf club shaft.

4. The golf club grip of claim 1, wherein the inner section comprises an open-cell or closed-cell foam.

5. The golf club grip of claim 1, wherein the inner section comprises a viscoelastic foam.

6. The golf club grip of claim 1, wherein the outer layer comprises an open cell or closed-cell foam.

7. The golf club grip of claim 1, wherein the outer layer comprises a viscoelastic foam.

8. A golf club grip comprising:

an outer layer, a portion of the outer layer substantially conforming to a player's grip when gripped, the gripped portion of the outer layer returning to and maintaining a substantially circular cross section when released by the player's grip; and an inner section, the inner section being moldable to substantially conform to the player's grip and maintaining a shape which substantially conforms to the player's grip for a period of time after the golf club grip is gripped and released and the gripped portion of the outer layer has returned to a substantially circular cross section.

9. The golf club grip of claim 8, wherein the inner section comprises clay.

10. The golf club grip of claim 8, wherein the inner section comprises an open-cell or closed-cell foam.

11. The golf club grip of claim 8, wherein the inner section comprises a viscoelastic foam.

12. The golf club grip of claim 8, wherein the outer layer comprises an open-cell or closed-cell foam.

13. The golf club grip of claim 8, wherein the outer layer comprises a viscoelastic foam.

14. The golf club grip of claim 8, wherein the durometer of the inner layer is greater than the durometer of the outer layer.

* * * * *